US008253085B1

(12) United States Patent
Lichtenberg-Scanlan et al.

(10) Patent No.: US 8,253,085 B1
(45) Date of Patent: Aug. 28, 2012

(54) FIN DEPLOYMENT APPARATUS FOR PROJECTILE

(75) Inventors: Adam Lichtenberg-Scanlan, Jersey City, NJ (US); Christopher Stout, Hoboken, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 210 days.

(21) Appl. No.: 12/858,656

(22) Filed: Aug. 18, 2010

(51) Int. Cl.
*F42B 15/01* (2006.01)

(52) U.S. Cl. ..... 244/3.27; 244/3.24

(58) Field of Classification Search ..... 244/3.22, 244/3.24, 3.27–3.3
See application file for complete search history.

(56) References Cited

U.S. PATENT DOCUMENTS

2005/0082419 A1* 4/2005 Dryer et al. ..... 244/3.3
* cited by examiner

*Primary Examiner* — Tien Dinh
*Assistant Examiner* — Nicholas McFall
(74) *Attorney, Agent, or Firm* — Henry S. Goldfine

(57) ABSTRACT

A projectile may include a body and a base fixed to a rear end of the body. The base may include a gas cavity and an opening extending from a rear end of the base to the gas cavity. A retention plug may be disposed in the opening wherein a fit between the retention plug and the opening is such that propellant gas pressure in the gas cavity forces the retention plug out of the opening. The retention plug may include at least one gas conduit between an outer surface of the retention plug and the gas cavity. A plurality of fins may be rotatably fixed to the base. The fins may have a folded position and a deployed position.

18 Claims, 8 Drawing Sheets

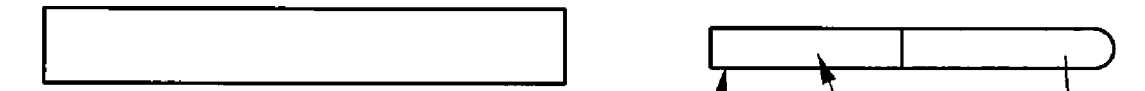
Fig. 1
Prior Art
Fig. 2
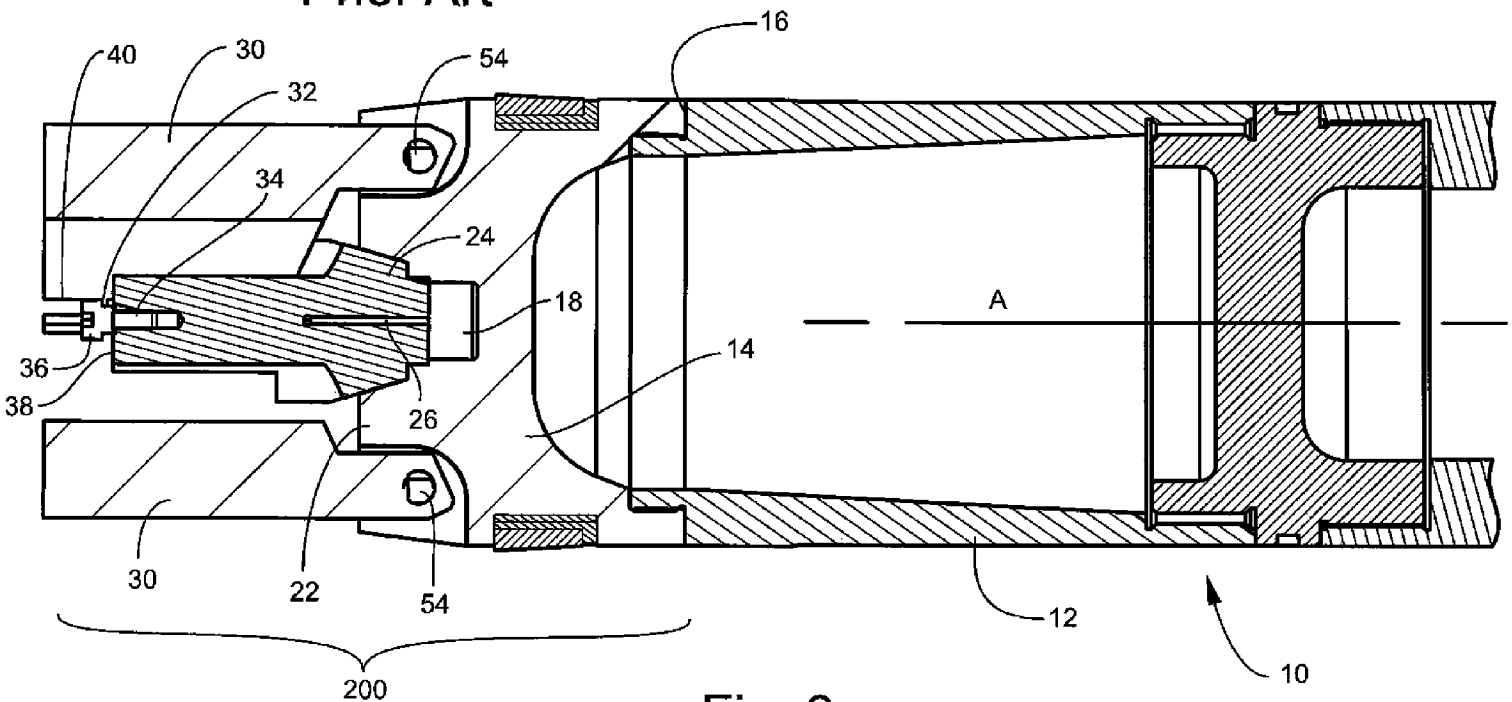
Fig. 3

FIN DEPLOYMENT APPARATUS FOR PROJECTILE

STATEMENT OF GOVERNMENT INTEREST

The inventions described herein may be manufactured, used and licensed by or for the U.S. Government for U.S. Government purposes.

BACKGROUND OF THE INVENTION

The invention relates, in general to munitions and, in particular, to tube-launched or gun-launched projectiles.

Some gun-launched projectiles may include guidance systems. Guidance systems may include components such as, for example, control motors and electronics. The guidance system components may require that the projectile spin at a low spin rate. The low spin rate may decrease the stability of the projectile. Fins may be used to increase the stability of the projectile. While a projectile is in a gun tube, the projectile's fins may be damaged by uneven loads produced by propellant gases. A need exists for a method and apparatus for protecting fins while in a gun tube, and then deploying the fins after the projectile exits the gun tube.

SUMMARY OF THE INVENTION

It is an object of the invention to provide a method and apparatus for protecting fins while in a gun tube, and then deploying the fins after the projectile exits the gun tube.

One aspect of the invention is a projectile. The projectile may include a body and a base fixed to a rear end of the body. The base may include a gas cavity and an opening extending from a rear end of the base to the gas cavity. A retention plug may be disposed in the opening. A fit between the retention plug and the opening may be such that propellant gas pressure in the gas cavity forces the retention plug out of the opening.

The retention plug may include at least one gas conduit between an outer surface of the retention plug and the gas cavity. A plurality of fins may be rotatably fixed to the base. The fins having a folded position and a deployed position.

A retention screw may be adjustably disposed in a rear end of the retention plug. A tab may be disposed on an inner edge of each fin. The retention screw may bear against the tabs to maintain the fins in the folded position. The retention plug may include a plurality of slots formed therein. When the fins are in the folded position, a portion of each fin may be disposed in a respective one of the slots.

The base may include a slot and a fin shaft opening for each fin. A fin shaft may be connected to each fin. Each fin shaft may be rotatably disposed in the fin shaft opening in the base. A spring-loaded pin may be disposed in each fin shaft. The spring-loaded pin may lock the fin in the deployed position.

Prior to launch, the projectile may be seated in a cartridge having propellant therein.

Another aspect of the invention is a method. The method may include providing a projectile as described above. The projectile may be seated in a cartridge having propellant. The method may include igniting the propellant and filling the gas cavity of the base of the projectile with gas produced by combustion of the propellant. When the projectile exits a gun tube, the method may include forcing the retention plug out of the base and moving the fins from the folded position to the deployed position.

After moving the fins to the deployed position, the method may include locking the fins in the deployed position.

A further aspect of the invention is a fin deployment apparatus. The fin deployment apparatus may include a base having a gas cavity and an opening extending from a rear end of the base to the gas cavity. A retention plug may be disposed in the opening. A fit between the retention plug and the opening may be such that propellant gas pressure in the gas cavity forces the retention plug out of the opening.

The retention plug may include at least one gas conduit between an outer surface of the retention plug and the gas cavity. A plurality of fins may be rotatably fixed to the base. The fins may have a folded position and a deployed position.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 1 is a schematic drawing of a gun tube for launching a projectile having a fin deployment apparatus.

FIG. 2 is a schematic drawing of a cartridge and a projectile having a fin deployment apparatus.

FIG. 3 is an enlarged, sectional view of the rear portion of an embodiment of a projectile with a fin deployment apparatus.

DETAILED DESCRIPTION OF THE PREFERRED EMBODIMENTS

A fin deployment apparatus may support the rear fins of a projectile. A fin deployment apparatus may maintain the rear fins in a stowed configuration until the entire projectile has exited the gun tube muzzle. After exiting the muzzle, a fin deployment apparatus may function by using the differential pressure between a pressurized gas cavity of the fin deployment apparatus and the atmosphere surrounding the fin deployment apparatus. The differential pressure may push a plug out of and away from a base, thereby releasing and deploying the stabilizing fins. The plug may have an aerodynamic shape to ensure that it does not return to the gun site and inflict damage to the crew or equipment.

Once released, the fins may then mechanically lock at a desired angle from the base. It may be necessary for the fins to be released simultaneously due to the naturally low level of stability in some precision artillery. The low stability may be required to ensure adequate maneuverability of the projectile throughout its flight and in its terminal flight phase.

FIG. 1 is a schematic drawing of a gun tube 100 for launching a projectile having a fin deployment apparatus. Gun tube 100 may be, for example, an artillery tube, a tank barrel, etc.

FIG. 2 is a schematic view of a projectile 10 seated in a cartridge 102. Cartridge 102 may contain propellant 104.

Figures 4A, 4B:
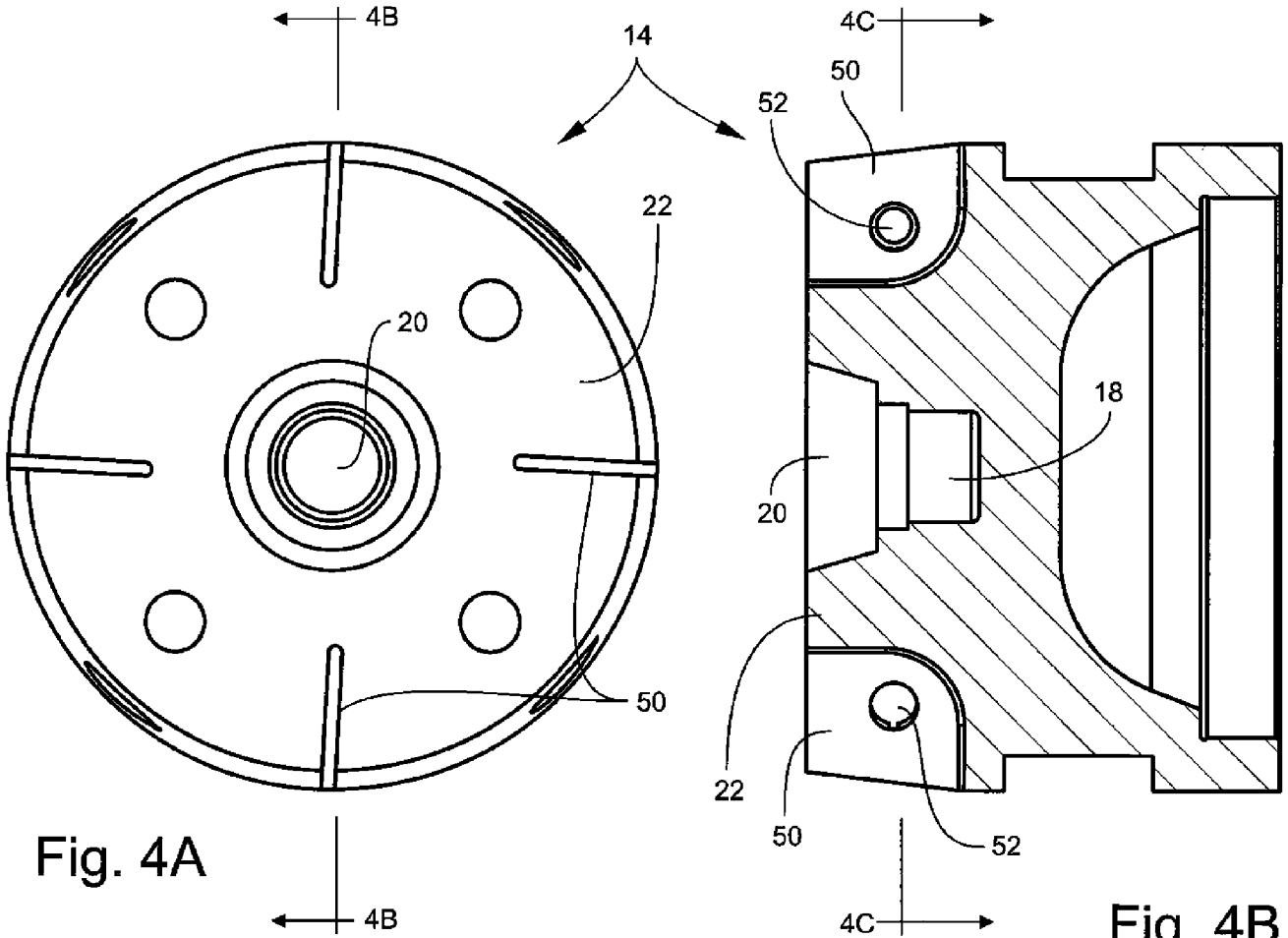
FIG. 4A is a rear view of an embodiment of a base for a fin deployment apparatus.
FIG. 4B is a sectional view along the line 4B-4B of FIG. 4A.
Figure 4C:
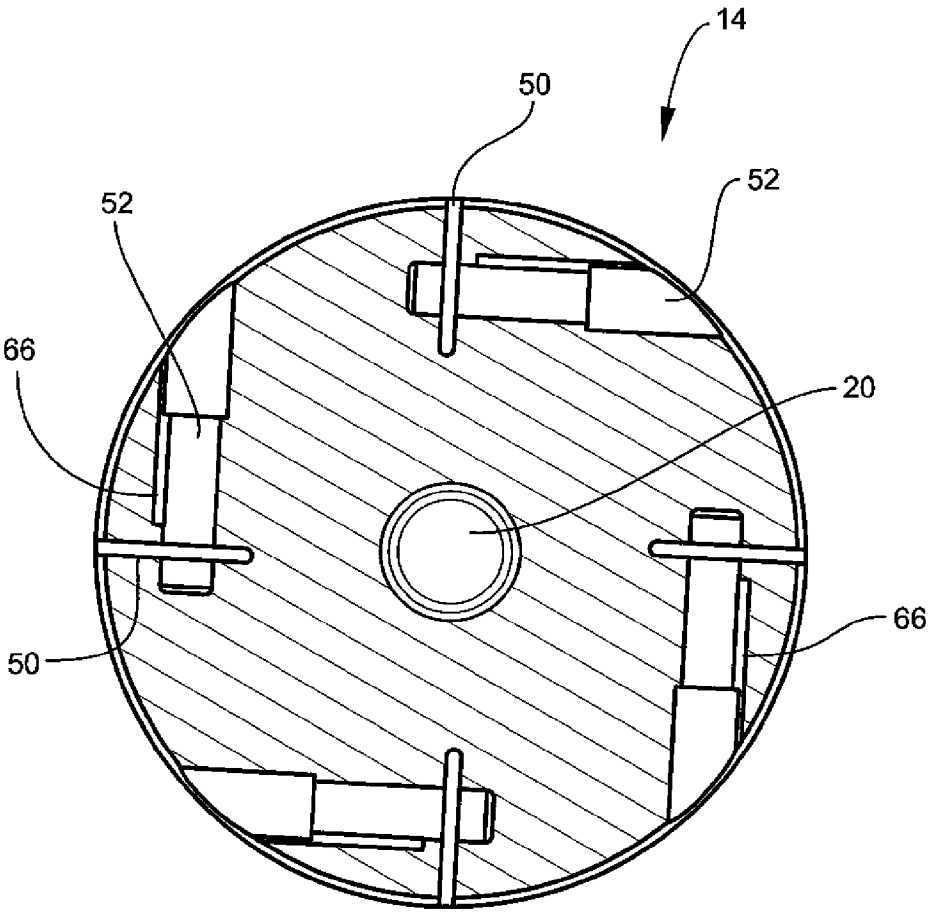
FIG. 4C is a sectional view along the line 4C-4C of FIG. 4B.

FIG. 3 is an enlarged, sectional view of the rear portion of an embodiment of a projectile 10 with a fin deployment apparatus 200. Projectile 10 may have a longitudinal axis A and a body 12. Fin deployment apparatus 200 may include a base 14 fixed to a rear end 16 of body 12. Base 12 may include a gas cavity 18 and an opening 20 (See FIGS. 4A-C) extending from a rear end 22 of base 14 to gas cavity 18. A retention plug 24 (FIG. 3) may be disposed in opening 20.

Figure 5C:
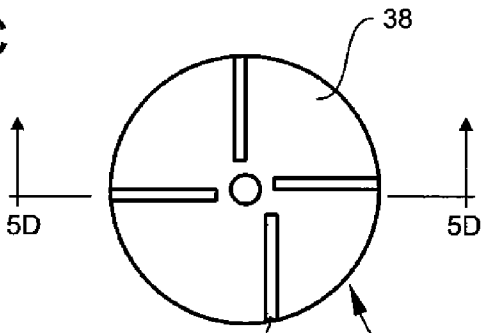
FIG. 5C is a top view of the plug of FIG. 5A.
Figure 5D:
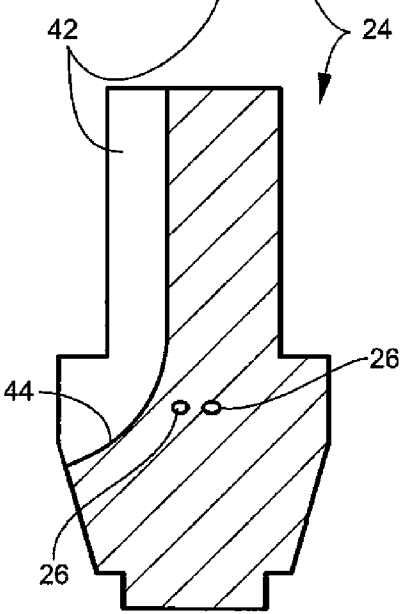
FIG. 5D is a sectional view along the line 5D-5D of FIG. 5C.
Figure 5A:
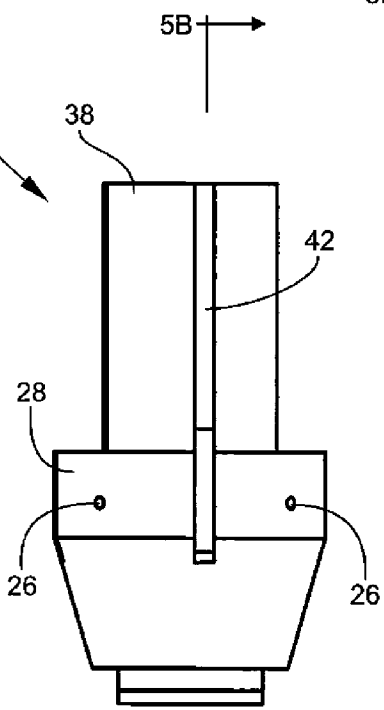
FIG. 5A is a perspective view of an embodiment of a retention plug for a fin deployment apparatus.
Figure 5B:
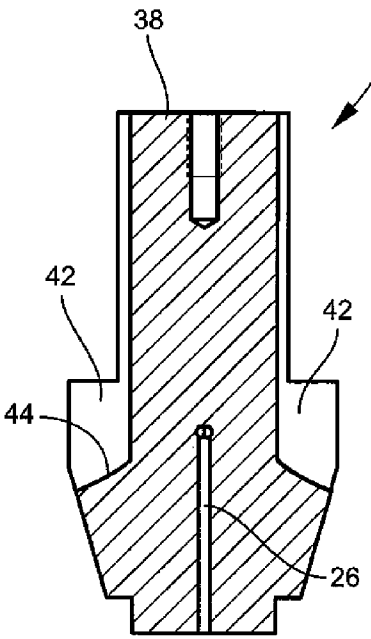
FIG. 5B is a sectional view along the line 5B-5B of FIG. 5A.

A fit between retention plug 24 and opening 20 may be such that propellant gas pressure in gas cavity 18 forces retention plug 24 out of opening 20. For example, the fit between plug 24 and opening 20 may be a press type of fit with an overlap of, for example, about 0.001 inches. Retention plug 24 may include at least one gas conduit 26 (see also FIGS. 5A-D) between an outer surface (FIG. 5A) of retention plug 24 and gas cavity 18. In one embodiment, there may be four gas conduits 26 spaced about ninety degrees apart.

After ignition of propellant 104 (FIG. 2), the high pressure propellant gases may fill gas cavity 18 via conduits 26 before projectile 10 exits gun tube 100. The pressure of the propellant gases in tube 100 may be, for example, about 20,000 psi. When projectile 10 exits tube 100, the high pressure gas in cavity 18 may force plug 24 out of opening 20. Movement of plug 24 rearwardly causes fins 30 to rotate open, as will be explained in more detail.

Figure 6:
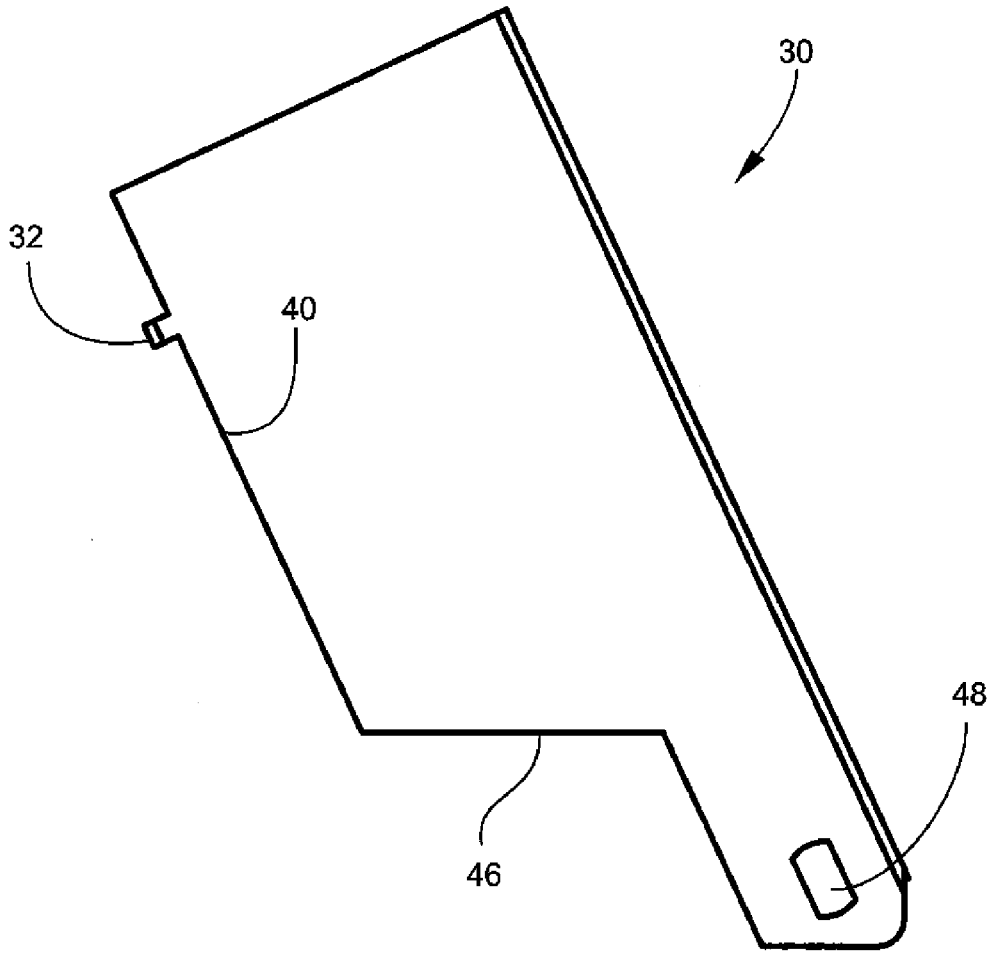
FIG. 6 is a side view of an embodiment of a fin.
Figure 9:
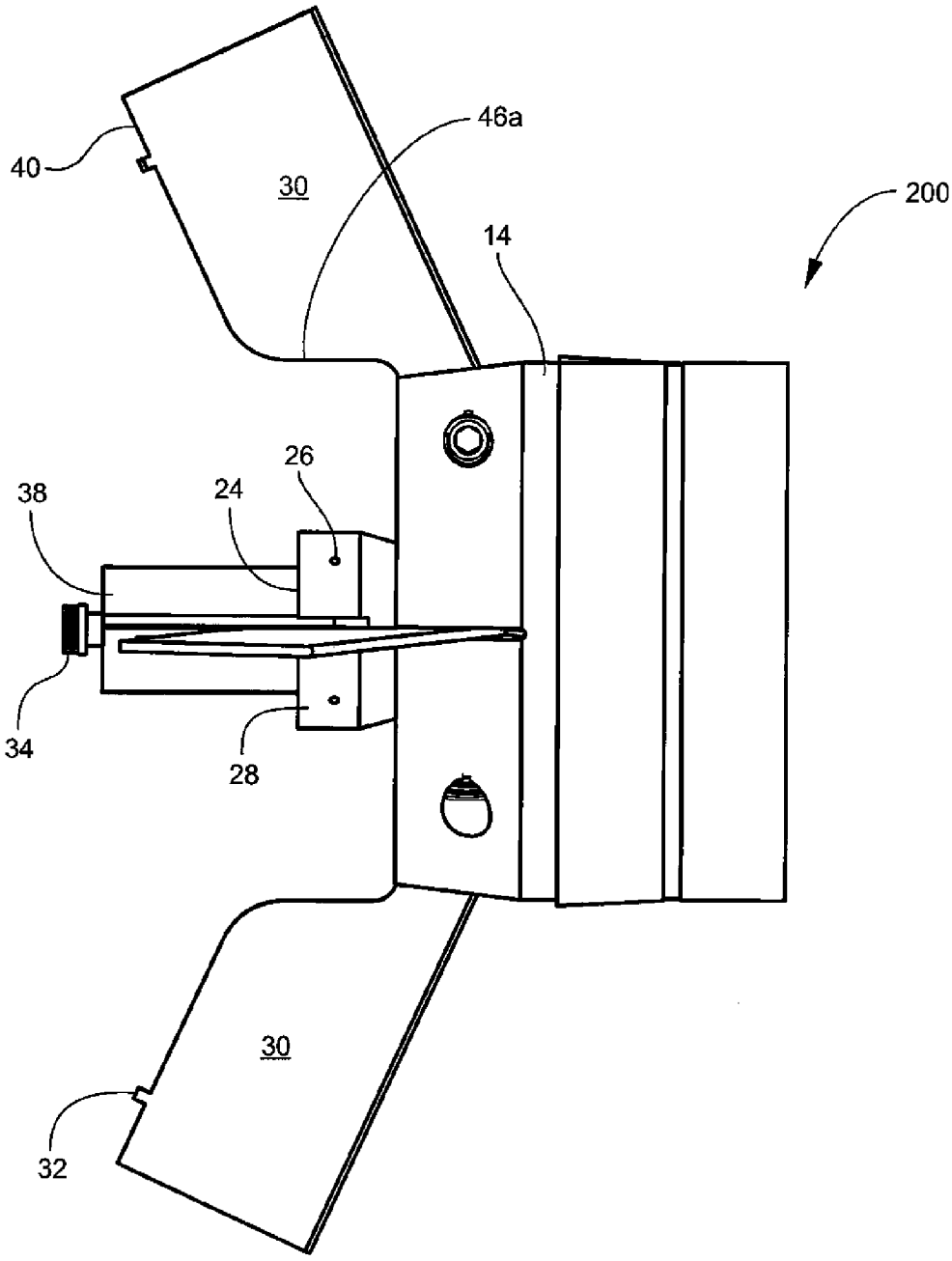
FIG. 9 is a side view of an embodiment of a fin deployment apparatus with the fins in a deployed position.

A plurality of fins 30 may be rotatably fixed to base 14. Fins 30 may comprise, for example, steel. Fins 30 may have a folded position, as in FIG. 3, and a deployed position, as in FIG. 9. Each fin 30 may include a tab 32 (FIG. 6) disposed on an inner edge 40 of the fin 30. Each fin 30 may include an opening 48 for receiving a fin shaft 54.

Fins 30 may be maintained in the folded position with a retention screw 34 (FIG. 3) that may interact with tabs 30. Retention screw 34 may be adjustably disposed in a rear end 38 of retention plug 24. For example, retention screw 34 may be threaded into rear end 38 of plug 24. Retention screw 34 may include a head 36.

In the position shown in FIG. 3, tabs 32 may be disposed beneath (forward of) head 36. Retention screw 34 may be threaded inwardly to bear against tabs 32 and thereby maintain fins 30 in the folded position. A gap may exist between forward edges of tabs 30 and rear end 38 of plug 24. The gap allows the fins 30 to be unlocked as plug 24 and retention screw 34 move rearward after projectile 10 exits gun tube 100.

Retention plug 24 may include a plurality of slots 42 (FIGS. 5A-5D) formed therein. When fins 30 are in the folded position, a portion of each fin 30 may be disposed in a respective one of the slots 42. A forward edge 44 of each slot 42 may be curvilinear. A forward edge 46 (FIG. 6) of each fin 30 may be linear. Alternatively, a forward edge 46*a* (FIG. 9) of each fin 30 ma be curved.

Figure 7B:
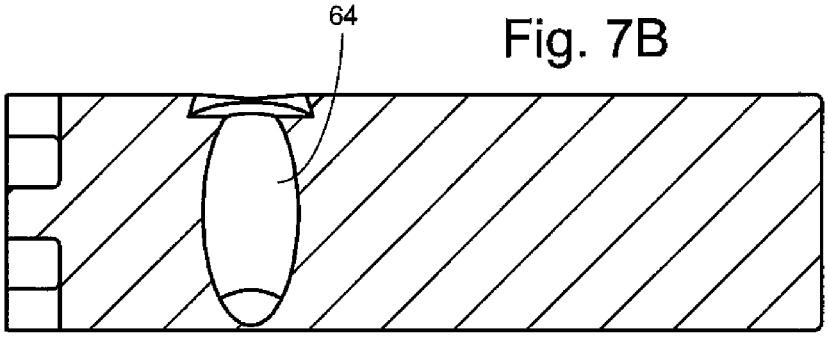
FIG. 7B is a sectional view along the line 7B-7B of FIG. 7A.
Figure 7A:
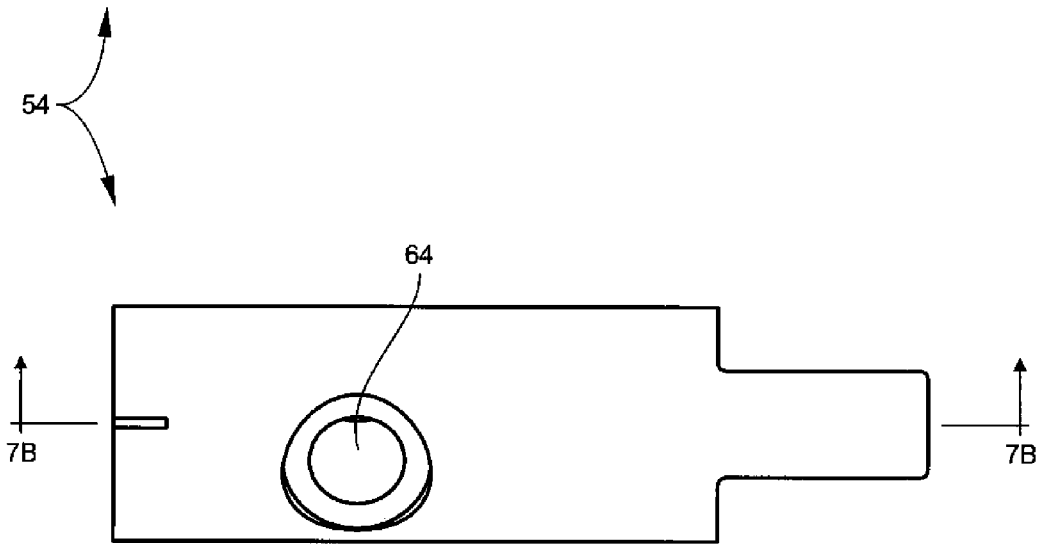
FIG. 7A is a side view of an embodiment of a fin shaft.

Base 14 (FIGS. 4A-4C) may include a slot 50 and a fin shaft opening 52 for each fin 30. Fin deployment apparatus 200 may further include a fin shaft 54 (FIGS. 3 and 7A-7B) connected to each fin 30. Fin shafts 54 may be rotatably disposed in fin shaft openings 52 in base 14. Each fin shaft 54 may include an opening 64 for housing a spring-loaded pin 58 (FIG. 8).

Figure 8:
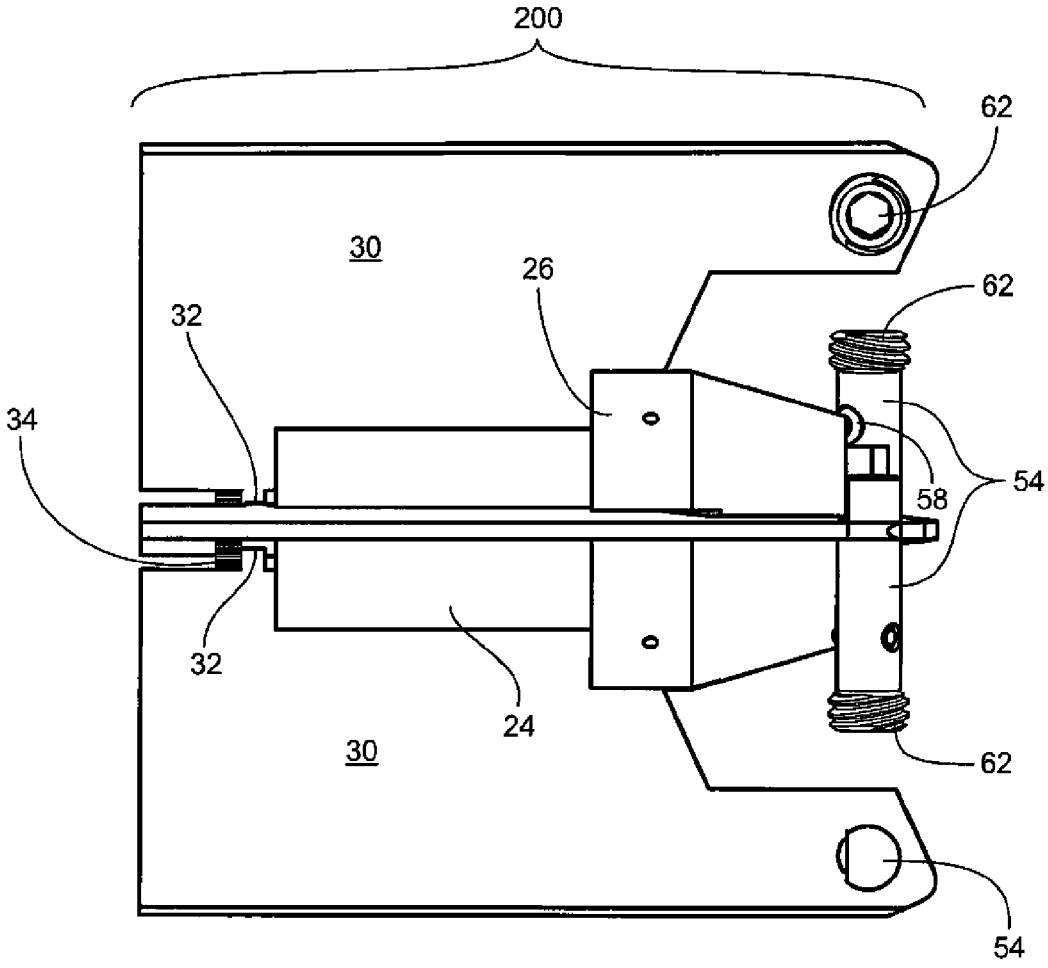
FIG. 8 is a side view of an embodiment of a fin deployment apparatus with the base removed, for clarity.

FIG. 8 is a side view of fin deployment apparatus 200 with base 14 removed, for clarity. Fins 30 are in the folded position with retention screw 34 bearing against tabs 32. Spring-loaded pins 58 are disposed in fin shafts 54. As shown in FIG. 8, set screws 62 may be disposed at one end of each fin shaft 54. Set screws 62 may threadingly engage fin shaft openings 52 (FIG. 4C) in base 14. Set screws 62 may not rotate with fin shafts 54.

After projectile 10 exits the gun muzzle, plug 24 with attached retention screw 36 may move rearward. Fins 30 may first be unlocked by movement of retention screw 36 away from tabs 32. As plug 24 moves further rearward, fins 30 may rotate outwardly around fin shafts 54. When fins 30 have completed their outward rotation (deployed position of FIG. 9), spring-loaded pins 58 (FIG. 8) may extend outwardly into recesses 66 (FIG. 4C) formed adjacent fin shaft openings 52 in base 14. Extension of the spring-loaded pins 58 into recesses 66 may lock fins 30 in the deployed position.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile, comprising:

a body;

a base fixed to a rear end of the body, the base including a gas cavity and an opening extending from a rear end of the base to the gas cavity;

a retention plug disposed in the opening wherein a fit between the retention plug and the opening is such that propellant gas pressure in the gas cavity forces the retention plug out of the opening, the retention plug including at least one gas conduit between an outer surface of the retention plug and the gas cavity; and a plurality of fins rotatably fixed to the base, the fins having a folded position and a deployed position; and a retention screw adjustably disposed in a rear end of the retention plug and a tab disposed on an inner edge of each fin, wherein the retention screw bears against the tabs to maintain the fins in the folded position.

2. The projectile of claim 1, wherein the at least one gas conduit includes four gas conduits between the outer surface of the retention plug and the gas cavity.

3. The projectile of claim 1, wherein the retention plug includes a plurality of slots formed therein and further wherein, when the fins are in the folded position, a portion of each fin is disposed in a respective one of the slots.

4. The projectile of claim 3, wherein a forward edge of each slot is curvilinear.

5. The projectile of claim 3, wherein the base includes a slot and a fin shaft opening for each fin, the projectile further comprising a fin shaft connected to each fin, the fin shaft being rotatably disposed in the fin shaft opening in the base.

6. The projectile of claim 5, further comprising a spring-loaded pin disposed in each fin shaft wherein the spring-loaded pin locks each fin in the deployed position.

7. The projectile of claim 6, further comprising a set screw disposed at one end of each fin shaft, the set screw being fixed to the fin shaft opening in the base.

8. The projectile of claim 1, further comprising a cartridge and propellant disposed in the cartridge, the projectile being seated in the cartridge prior to launching the projectile.

9. A method, comprising:

providing the projectile of claim 8 in a gun tube;

igniting the propellant;

filling the gas cavity with gas produced by combustion of the propellant;

when the projectile exits the gun tube, forcing the retention plug out of the base; and moving the fins from the folded position to the deployed position.

10. The method of claim 9, further comprising, after moving the fins, locking the fins in the deployed position.

11. The method of claim 9, wherein filling the gas cavity includes channeling the gas through the at least one gas conduit.

12. The method of claim 11, further comprising, before moving the fins, unlocking the fins from the retention plug.

13. The method of claim 12, wherein unlocking the fins includes moving the retention plug rearwardly.

14. The method of claim 9, wherein providing the projectile includes disposing the fins in the folded position in slots in the retention plug.

15. A fin deployment apparatus, comprising:

a base having a gas cavity and an opening extending from a rear end of the base to the gas cavity;

a retention plug disposed in the opening wherein a fit between the retention plug and the opening is such that propellant gas pressure in the gas cavity forces the retention plug out of the opening, the retention plug including at least one gas conduit between an outer surface of the retention plug and the gas cavity; and a plurality of fins rotatably fixed to the base, the fins having a folded position and a deployed position; and a retention screw adjustably disposed in a rear end of the retention plug and a tab disposed on an inner edge of each fin, wherein the retention screw bears against the tabs to maintain the fins in the folded position.

16. The apparatus of claim 15, wherein the retention plug includes a plurality of slots formed therein and further wherein, when the fins are in the folded position, a portion of each fin is disposed in a respective one of the slots.

17. The apparatus of claim 16, wherein a forward edge of each slot is curvilinear.

18. The apparatus of claim 16, wherein the base includes a slot and a fin shaft opening for each fin, the projectile further comprising a fin shaft connected to each fin, the fin shaft being rotatably disposed in the fin shaft opening in the base.

* * * * *